US008042473B2

(12) United States Patent
Buckley et al.

(10) Patent No.: US 8,042,473 B2
(45) Date of Patent: Oct. 25, 2011

(54) TIE PLATE SINGULARIZATION DEVICE

(75) Inventors: Stephen Philip Buckley, Kansas City, MO (US); Steven D. Graham, Overland Park, KS (US); James Spencer Mansheim, Kansas City, MO (US)

(73) Assignee: Timothy Charles Taylor, Marietta, GA (US)

( * ) Notice: Subject to any disclaimer, the term of this patent is extended or adjusted under 35 U.S.C. 154(b) by 105 days.

(21) Appl. No.: 12/611,169

(22) Filed: Nov. 3, 2009

(65) Prior Publication Data

US 2011/0100248 A1 May 5, 2011

(51) Int. Cl.
*E01B 3/00* (2006.01)

(52) U.S. Cl. ..... 104/16; 104/2

(58) Field of Classification Search ..... 104/2, 3, 104/5, 8, 9, 16
See application file for complete search history.

(56) References Cited

U.S. PATENT DOCUMENTS

| | | | | | |
|---|---|---|---|---|---|
| 4,178,237 | A | * | 12/1979 | Theurer | 209/215 |
| 4,178,671 | A | | 12/1979 | Luttig | |
| 4,225,429 | A | * | 9/1980 | Holley | 209/215 |
| 4,241,663 | A | * | 12/1980 | Lund et al. | 104/16 |
| 4,280,613 | A | | 7/1981 | Stewart | |
| 4,691,639 | A | * | 9/1987 | Holley | 104/16 |
| 4,722,283 | A | * | 2/1988 | Holley | 104/279 |
| 4,727,989 | A | | 3/1988 | Cotic et al. | |
| 4,942,822 | A | | 7/1990 | Cotic | |
| 4,974,518 | A | * | 12/1990 | Cotic et al. | 104/16 |
| 5,067,412 | A | | 11/1991 | Theurer et al. | |
| 5,331,899 | A | * | 7/1994 | Holley | 104/16 |
| 5,655,455 | A | | 8/1997 | Smith | |
| 5,722,325 | A | | 3/1998 | Glomski et al. | |
| 5,839,377 | A | | 11/1998 | Brenny et al. | |
| 6,170,401 | B1 | | 1/2001 | Miller et al. | |
| 6,595,140 | B1 | | 7/2003 | Madison et al. | |
| 6,807,909 | B1 | * | 10/2004 | Coots | 104/16 |
| 6,863,717 | B2 | * | 3/2005 | Johnsen et al. | 106/6 |
| 7,244,089 | B2 | * | 7/2007 | Sperling | 414/434 |
| 7,421,952 | B2 | * | 9/2008 | Taylor | 104/2 |
| 7,497,166 | B2 | | 3/2009 | Fuerst et al. | |
| 7,827,916 | B2 | * | 11/2010 | Coots, Jr. | 104/16 |
| 2007/0283837 | A1 | | 12/2007 | Brenny et al. | |
| 2008/0163780 | A1 | * | 7/2008 | Theurer et al. | 104/2 |
| 2009/0133598 | A1 | * | 5/2009 | Coots, Jr. | 104/2 |
| 2010/0132582 | A1 | * | 6/2010 | Theurer et al. | 104/2 |
| 2010/0224096 | A1 | * | 9/2010 | Helmick | 104/2 |

* cited by examiner

*Primary Examiner* — S. Joseph Morano
*Assistant Examiner* — Jason C Smith
(74) *Attorney, Agent, or Firm* — Erickson Kernell Derussea & Kleypas, LLC

(57) ABSTRACT

A device for sorting railroad tie plates comprises hopper, singulator and chute assemblies mounted to a main frame capable of rolling movement along a railroad track. The device receives a plurality of tie plates from an upstream supply, e.g., a railroad gondola, and deposits the tie plates on the hopper assembly positioned above the singulator. Upon discharge from the hopper the tie plates are directed onto a central hub for guidance into a rotating track within the housing. The track width is selected so that the field and gage ends transverse the track upon the tie plates falling flat onto the track. Structure projects into the track to tip over the tie plates to a flat position during track rotation. Rotation of the track moves the tie plates towards a baffled opening for discharge from the opening. A chute assembly receives the tie plates and maintains the tie plate orientation for delivery to downstream devices, such as a conveyor belt. Upon rolling movement of the main frame tie plates are sequentially deposited along the course of the railroad track to enhance railroad track maintenance.

20 Claims, 5 Drawing Sheets

TIE PLATE SINGULARIZATION DEVICE

BACKGROUND OF THE INVENTION

This invention relates to a device for positioning tie plates along a railroad track and, more particularly, to a device which orients tie plates into a desired position for downstream delivery and ultimate deposit along a railroad track.

Railroad tracks comprise two steel rails transversing spaced-apart railroad ties. Atop each tie is a tie plate which connects each rail to the underlying tie. Each tie plate is generally rectangular in configuration having a field end position outside the rail and a gage end inside the rail. The width of the tie plate is defined as a distance between these ends. The tie plates can vary in dimension and weight with most tie plates having a dimension of 7¾" (L)×14¾" (W) and weighing approximately 23 pounds, or 8" (L)×18" (W) and weighing approximately 35 pounds.

One phase of railroad track maintenance is replacement of railroad ties. As such, there is a need for delivery of not only the railroad ties but also the tie plates from a storage area to locations along the railroad track. Previously, tie plates were dumped in piles along the railroad track requiring the workers to redistribute the tie plates to positions adjacent the railroad ties. Obviously, this is a very labor intensive operation which increased labor costs, work-related injuries and was not compatible with rapid, efficient railroad tie replacement. The rapidity of the railroad tie replacement is important so as to reduce the amount of down time that the tracks are unavailable for traffic.

Various devices have been proposed to enhance the operation of tie plate distribution. Such devices were relatively complex mechanisms and in some cases required a manual feed of the tie plates. Accordingly, a tie plate feeding crew was required which again raised labor costs, lead to injuries and created inefficiencies associated with manual tie replacement.

It is thus desirable to have an efficient device which singularizes tie plates from a mass tie plate supply so as to sequentially offer tie places to downstream devices in a desired orientation for ultimate placement along the course of a railroad track. The device should diminish, as much as possible, the need of workers to handle the tie plates prior to their deposit along the course of the railroad track. Also it is desirable to have a device which delivers the tie plates in a desired orientation so as to enhance the downstream tie plate replacement process.

SUMMARY OF THE INVENTION

In response thereto we have presented a tie plate singulator mounted to a support frame in rolling movement along a railroad track. The singulator receives a plurality of tie plates from an adjacent supply source such as a gondola car. A hopper receives a plurality of tie plates from the upstream supply source and directs the tie plates to the underlying singulator preferably having a carousel-like configuration. The singulator presents a cylindrical, open top housing with a hub centrally located therein. Displaced from the hub wall is the upstanding cylindrical housing wall. A floor of the housing cooperates with these hub and housing walls to form a track therebetween. The floor is rotatable about a central axis passing through the hub. Upon discharge of the tie plates from the overlying hopper the hub absorbs the initial impact of the falling tie plates and directs the tie plates onto the track between the hub and cylindrical walls. The track width is dimensioned so that during rotation the tie plates fall into a flat position atop the track with the field and gage ends generally transversing the track. This orientation is further achieved by ramp-like lugs along the housing wall and/or a band spanning the housing and hub above the track which tip over tie plates standing on edge on the track. Rotation of the track directs the oriented tie plates toward an opening in the housing wall. A baffle adjacent this opening extends across this track to preclude further movement of the tie plates on the track past the opening. As such, the baffle guides the tie plates through the opening for deposit into a chute assembly, the chute assembly having a discharge end displaced from the housing for deposit onto a conveyor belt therebelow. A bumper at the end of the chute absorbs energy from the discharged tie plate so as to direct a tie plate into a flat position prior to deposit on the underlying conveyor belt. As such, a plurality of tie plates are generally sequentially discharged from the housing in a desired orientation for slidable movement down the chute and singular deposit onto the underlying conveyor. Thus, the need for manual handling of the tie plates during the process is precluded. It is understood that various forms of devices may be placed downstream of the housing or chute assembly so as to further manipulate the tie plates upon their discharge from the singulator housing and/or chute assembly prior to their deposit along the railroad track.

It is therefore a general object of this invention to provide a device, movable along a railroad track, which receives a plurality of tie plates from a supply source and separates or singularizes the tie plates from the supply mass so as to deliver a general, sequential succession of tie plates for ultimate deposit along a railroad track.

Another general object of this invention is to provide a device, as aforesaid, which arranges the tie plates in a selected orientation.

A further object of the invention is to provide a device, as aforesaid, having a hopper for initial receipt of the tie plates from the supply source for delivery of the plurality of tie plates towards a downstream singularization device.

Another object of this invention is to provide a device, as aforesaid, wherein the singularization device includes a rotating track for reception of the tie plates thereon from the upstream hopper, the rotation of the track urging the tie plates towards a flat position thereon.

A still further object of this invention is to provide a singularization device, as aforesaid, having structure along the track to further orient the tie plates into a desired flat position facing the track.

A particular object of this invention is to provide a device, as aforesaid, which deposits the tie plates on the track at a track location to enhance the movement of the tie plates to the desired position during track rotation.

A still further object of this invention is to provide a device, as aforesaid, which deposits the tie plates onto the rotating track at a location spatially displaced at an optimum distance from the zone of plate discharge from the singularization device.

A more particular object of this invention is to provide a device, as aforesaid, which initially absorbs the impact of the tie plates falling from the hopper.

Another object of this invention is to provide a device, as aforesaid, which discharges the tie plates from the singularization device for further downstream manipulation.

Another particular object of this invention is to provide a chute assembly for receiving the tie plates discharged from the singularization device for further delivery of the tie plates to a downstream location.

A still further object of this invention is to provide a chute assembly, as aforesaid, which maintains the discharged tie plates in a desired orientation.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 1:
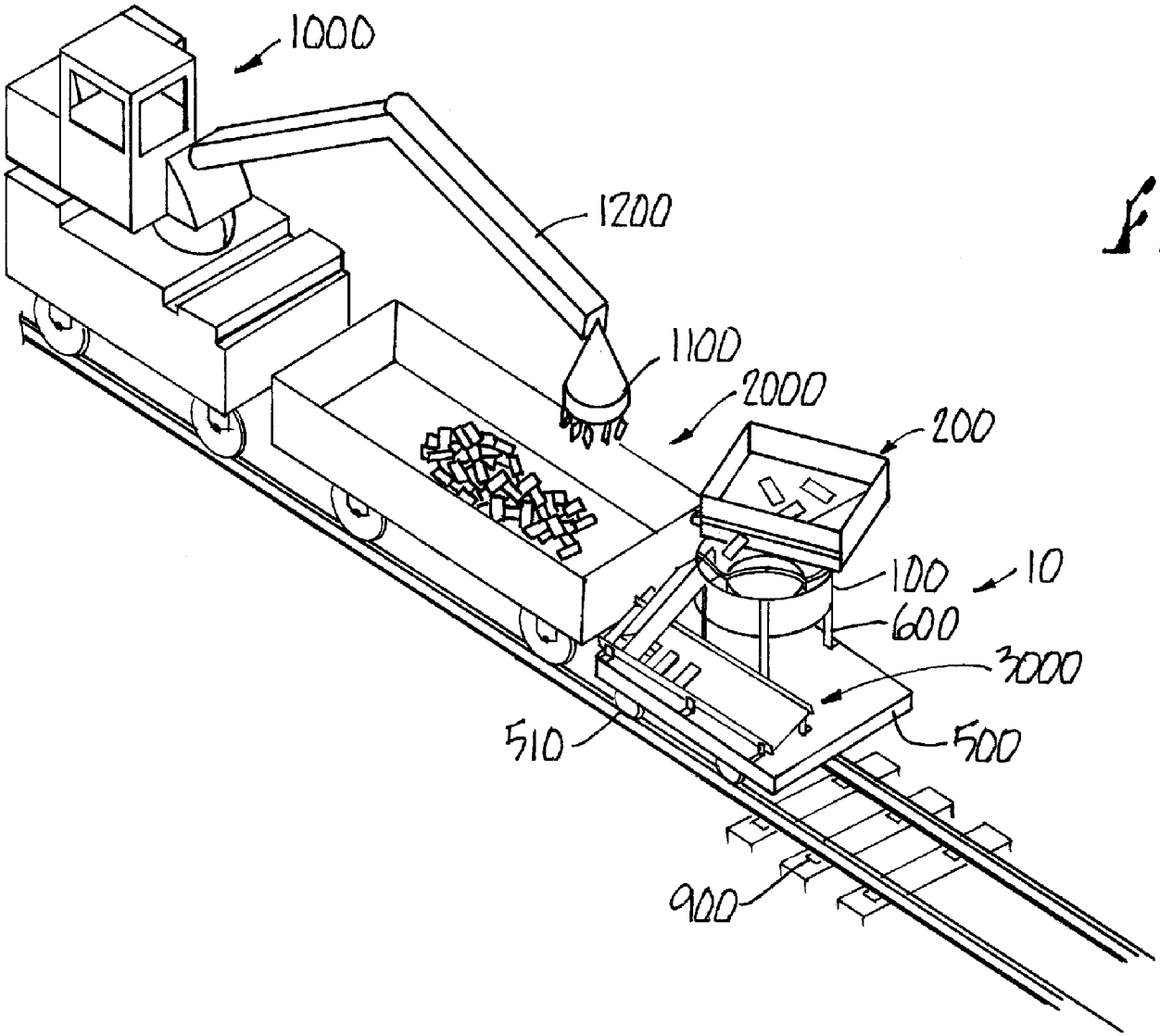
FIG. 1 is a diagrammatic perspective view showing the device in combination with an upstream gondola car and loader car and showing a conveyor belt for directing the singularized tie plates downstream.
Figure 6:
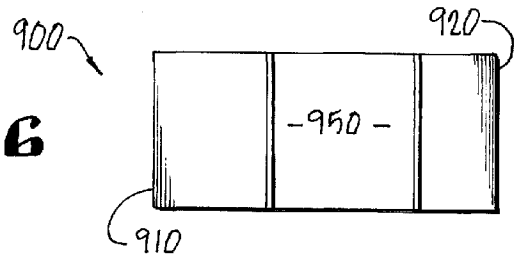
FIG. 6 is a top view of the tie plate of the FIG. 5 tie plate.
Figure 5:
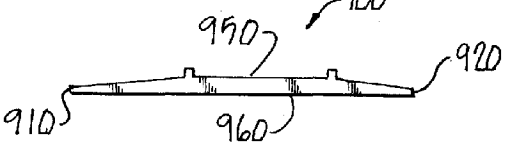
FIG. 5 is an end view of a tie plate.

Turing more particularly to the drawings, FIGS. 5-6 show a tie plate 900 as having a rectangular configuration with the width extending between the field 910 and gage 920 ends. FIG. 1 diagrammatically shows the singularization device 10 as used with a loader car 1000. One type of loader car is shown in U.S. Pat. No. 7,421,952 owned by T. C. Taylor, which is fully incorporated by reference herein. The loader 1000 is utilized with a gondola car 2000 holding a plurality of tie plates therein. A magnet 1100, located at the end of the loader boom 1200, picks up a plurality of tie plates 900 from gondola 2000 for downstream delivery to the singularization device 10 as to be described. The device 10 receives a plurality of tie plates for generally singularizing and orienting the tie plates for downstream delivery. One form of a downstream device is the straight line conveyor 3000 which receives the oriented tie plates on a sequential basis.

The now preferred embodiment of the device 10 comprises a singulator housing 100, upstream hopper assembly 200 and a chute assembly 300 for receiving tie plates discharged from the housing 100 for further downstream delivery. The device 10 is capable of being mounted on a wheeled main frame assembly 500 for rolling movement along the railroad track as provided by a pair of axles which track engaging wheels 510 thereon. It is understood that this main frame assembly 500 and device 10 support structure can be of various configurations, e.g., the upstanding legs 600 for attachment to main frame 500.

The housing 100 is generally cylindrical in configuration presenting an upstanding circular wall 110 having an exterior 120 and interior 130 surfaces. The wall encloses a central hub 150 having a sloped top surface 154 and an upstanding circular wall 152 spaced from the interior surface 130 of the housing wall 110.

A free bottom wall 160 of housing provides underlying support for tie plates 900 deposited thereon. Wall 160 is attached to a rotating shaft 182 extending from motor 180. An underlying wall 162 further supports housing wall 110. Wall 160 cooperates with the housing wall surface 130 and hub wall 152 to form a rotating track 170 therebetween for tie plates deposited thereon.

Figure 8:
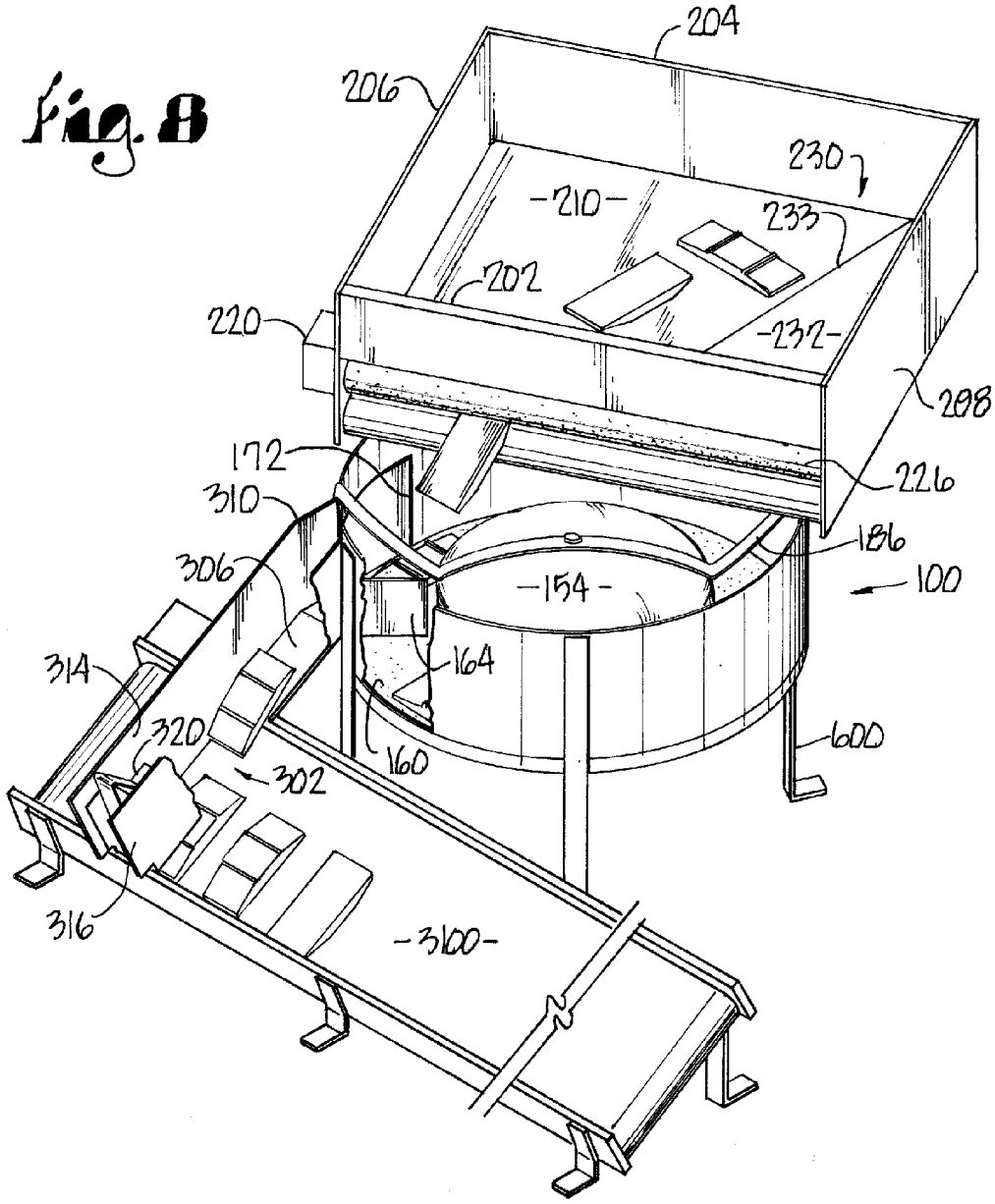
FIG. 8 is a superior perspective view of the singularization device.

Further included in housing wall 110 is an opening 172 sufficient for a flat tie plate 900 or stacked tie plates to pass therethrough as best seen in FIG. 8. A baffle 164, positioned adjacent aperture 172, extends from wall 110 surface 130 across the track 170 and towards hub 150 for a purpose to be subsequently described.

Figure 4:
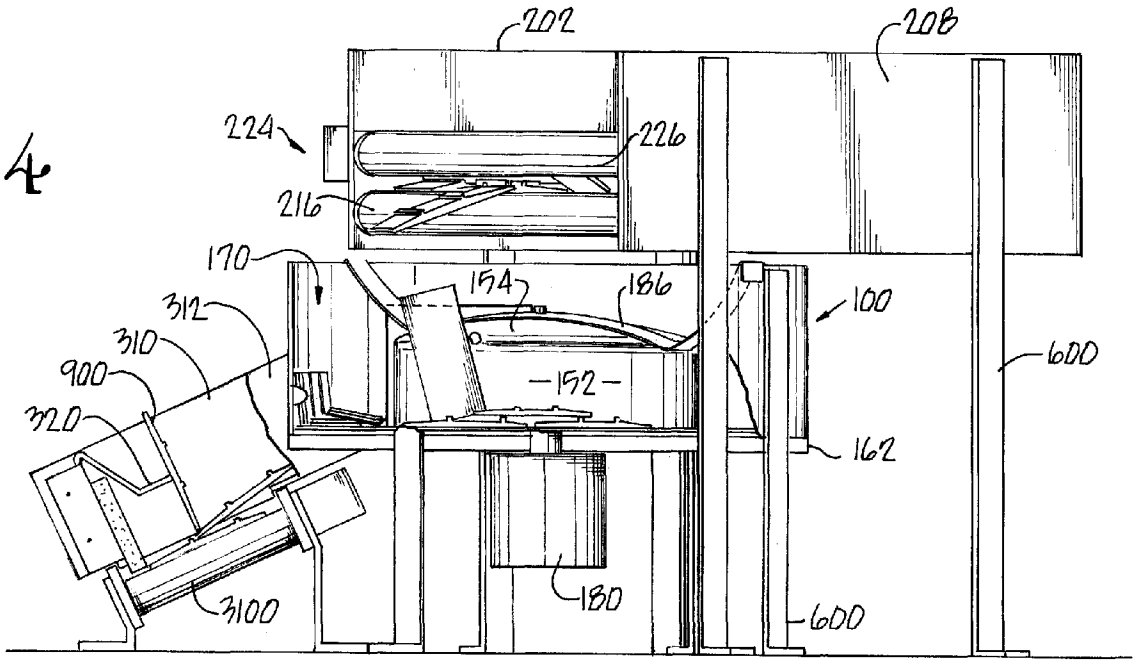
FIG. 4 is an opposed view of the assemblies shown in FIG. 3 with portions of walls broken away to better show elements therein.

Extending from the aperture 172 is a chute assembly 300 having a first end in communication with opening 172 and an open discharge end 302 displaced from the housing 100. The chute assembly includes an inclined surface/ramp 306 extending from the housing opening 172 and presents a free end 308. Chute surface 306 is bounded by a pair of upstanding, spaced-apart walls 310, 312 extending from opening 172. Further extending from side walls 310, 312 and beyond the chute ramp 306 is a second pair of side walls 314, 316. Walls 314, 316 support a resilient piece of angled metal 320 facing ramp 306 and presenting a bumper surface. Bumper 320 absorbs the impact of a contacting tie plate 900 sliding down the chute ramp 306 prior to falling below the side walls 314, 316. In some cases a tie plate 900 sliding down the chute may stand on its gage or field end (FIG. 4). Bumper 320 contact urges the tie plate 900 towards ramp 306 into a flat position. Located under the chute assembly 300 is a motor powered conveyor belt assembly 3000 which receives a tie plate discharged from the chute assembly 300.

Figure 2:
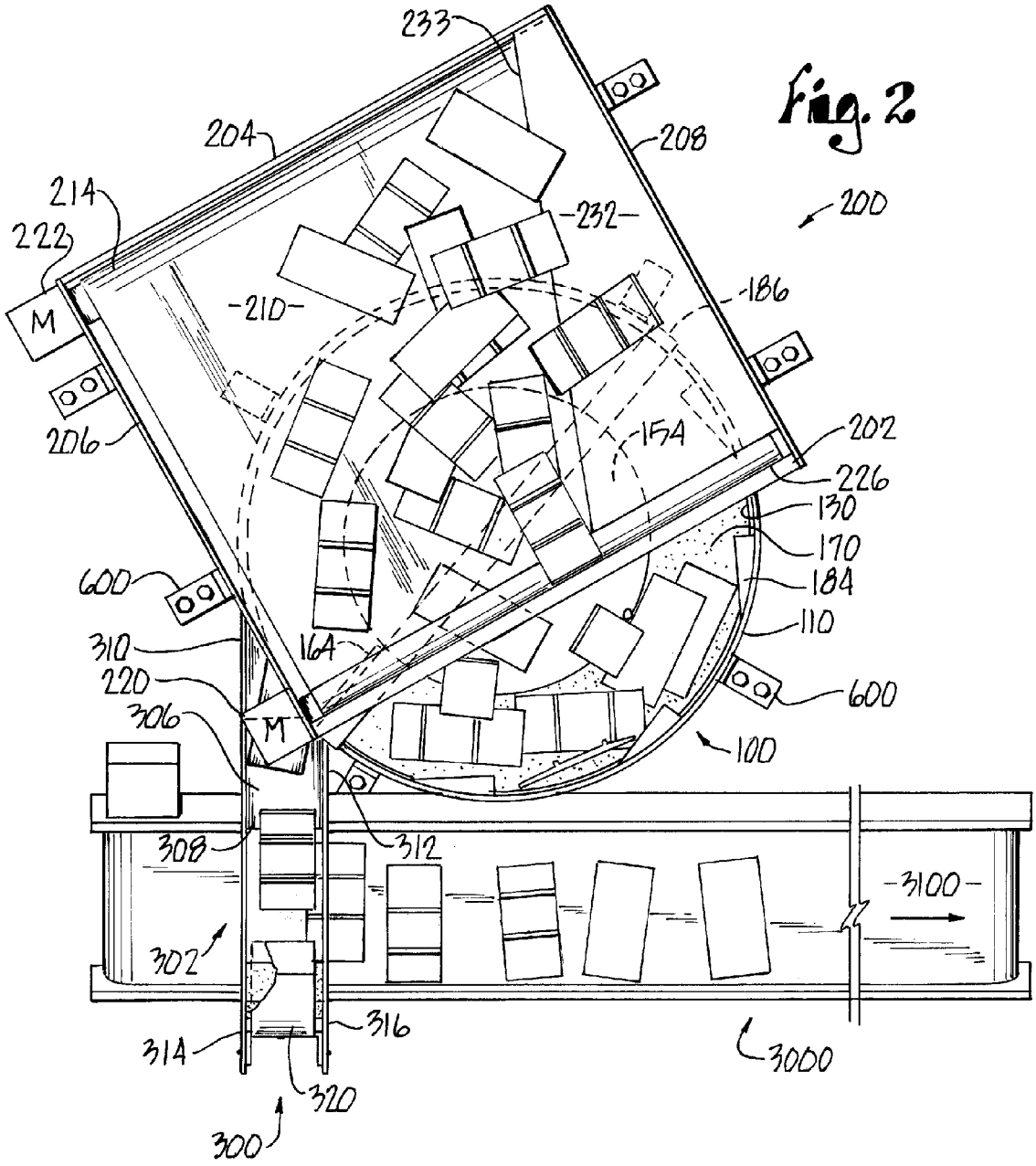
FIG. 2 is a top plan view of the hopper, singulator, chute and conveyor belt assemblies.

Superiorly positioned atop the housing 100 and mounted to the housing wall 110 is a hopper assembly 200. Hopper assembly includes a main frame having an end wall 204 and spaced apart side walls 206, 208. Main frame 201 supports a motor-powered conveyor belt 210 extending about rollers 214, 216 which extend between side walls 206, 208. Roller 214 is driven by hydraulic motor 222 in fluid communication with the hydraulic system of loader car 1000 incorporated by reference herein. The discharge end 224 of belt preferably extends over the housing 100 so that the discharge end extends beyond at least half of the top surface 154 portion of the hub 150 and is immediately counterclockwise of opening 172 as viewed in FIG. 2. At the discharge end is a motor 220 powered roller 226 spaced from belt surface 210 so as to present a slot for passage of flat tie plates therebetween. End wall 202 is positioned above roller 226 and extends between walls. A guide 230 presents an inclined top surface 232 and angled side wall 233. Side wall 233 directs tie plates towards one side of the discharge end 224.

Figure 3:
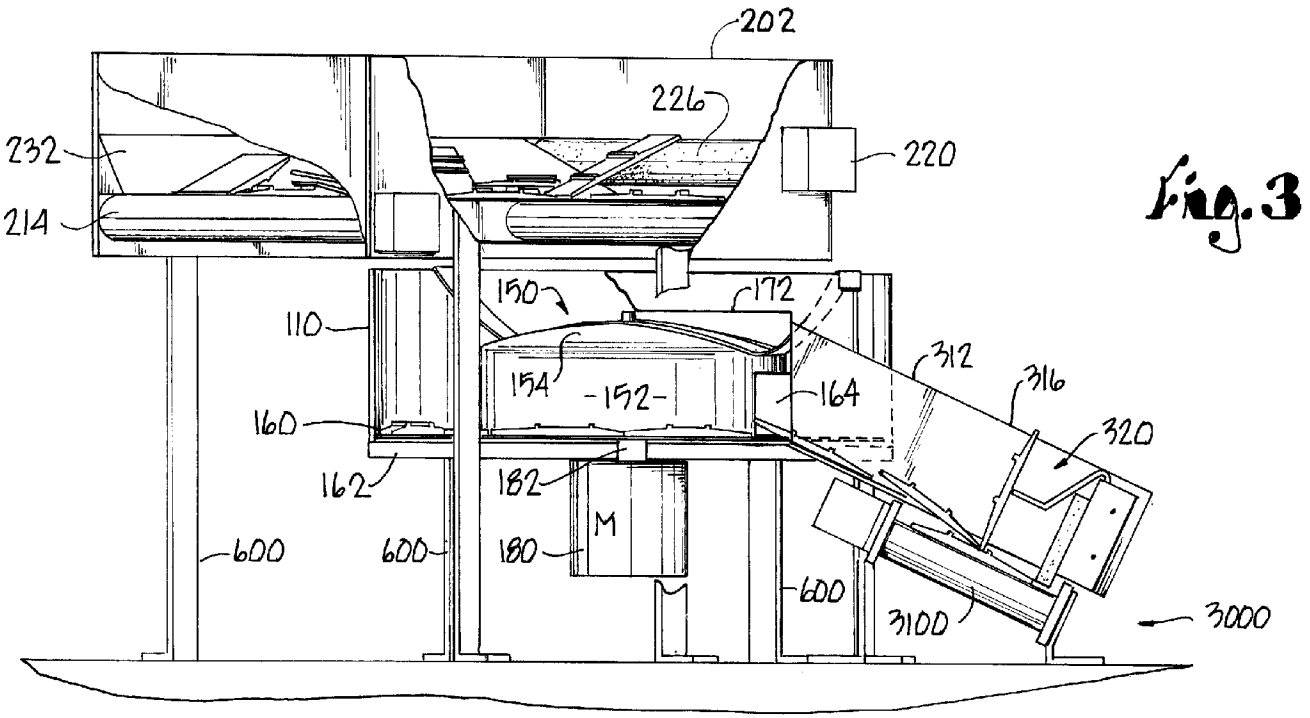
FIG. 3 is a side view of the hopper, singulator, chute and conveyor belt assemblies with portions of walls broken away to better show elements therein.
Figure 7:
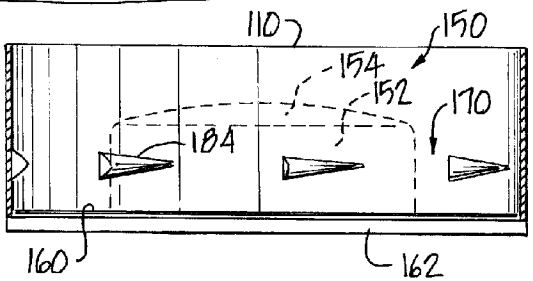
FIG. 7 is a view of a portion of the inside wall of the singulator assembly with the central hub being shown in phantom.

In use the operator of loader 1000 positions magnet 1100 so as to pick up tie plates 900 from the gondola 2000 and deposit the tie plates onto the moving belt 210 of hopper 200. The inclined surface 232 of guide 230 directs contacting plates onto the moving belt 210 with the angled wall 234 directing the tie plates toward an end zone of discharge end 224. The conveyor belt 210 is moving toward the discharge end 224 such that the tie plates are directed to the slot presented between the motor powered roller 226 and belt surface 210. During this movement, tie plates may stack up or stand up on end at the discharge end 224 (FIG. 3). The roller 226 peels tie plates off tie plate stacks and/or knocks down standing tie plates into a flat position on belt 210 for subsequent movement through the slot. Thus, the movement of belt 210 and/or roller 226 urges the tie plates into a desired flat position on belt 210 through slot and beyond discharge end 224. In the flat position either the top or bottom surface of a tie plate 900 can be facing the underlying conveyor belt 210.

Upon discharge from the hopper 200 the tie plates initially fall into housing 100 with tie plates also contacting the upper surface 154 of hub 150. This upper surface 154 absorbs the initial impact from the falling tie plates which enhances the direction of the tie plates onto the rotating track 170 therebelow. As above described, the discharge end 224 of hopper is positioned such that the tie plates fall into housing 100 at a location counterclockwise beyond the baffle 164 and housing opening 172. Guide wall 233 aids in presenting a zone of falling tie plates adjacent opening 172. As the track is rotating in a counterclockwise direction, the tie plates, due to the discharge end 234 location, are falling onto the track 170 along a zone displaced greater than 180 degrees clockwise from opening 172. This prolonged distance, relative to opening 172, assures an optimum travel distance of tie plates between a point of impact on the track 170 and discharge from opening 172. This distance results in a desired tie plate 900 orientation thereon. A desired position is preferably a "flat" orientation, i.e., the top 950 or bottom 960 of a tie plate 900 is facing the track 172 whether immediately contiguous to the track or with another tie plate therebetween. Other "desired" positions may be achieved utilizing the principles disclosed herein.

The width of track 170 between the hub wall 152 and inner housing wall surface 130 is preferably less than the width of the tie plate and slightly greater than the length of the field 910 and gage 920 ends. As such the tie plate orients only in one flat position, i.e., the field and gage ends generally transverse the width of the track. Thus, the width (W) of the tie plate generally extends along the course of the track in the direction of rotation. Accordingly, the rotation of the track 170 urges each tie plate 900 to fall into this orientation as the track width cannot otherwise accommodate a different tie plate orientation on the track.

During track rotation some tie plates may remain standing on edge. A plurality of ramp-like lugs 184 are positioned along the inner housing wall 130 so as to engage any passing tie plates on edge in the track 170 during track rotation (counterclockwise as shown). Such lug 184 engagement will tip over these standing tie plates to further urge the tie plates to the desired flat position. A band 186 diametrically spans the housing 100 atop the hub 150. Thus, band 186 will further tip over tie plates 900 standing on end in the track 170 during rotation.

As above explained, the discharge end 23*r* of the hopper 200 is displaced over housing so as to cover at least half of track such that the tie plates are first deposited onto the track 170 at an optimal location counterclockwise of the housing opening 172 and baffle 164. As the track 170 is moving counterclockwise, this track rotation assures an optimal prolonged distance of a tie plate movement between track impact and opening 172, i.e., the tie plates must pass a plurality of lugs 184 and band 186 and travel greater than 180°. Thus, the tie plates are assured to be in a desired flat position as the tie plates approach the opening 172 for discharge from the housing 100 whether caused by track 170 rotation, lugs 184 or band 186.

Adjacent the discharge aperture 172 is a baffle 164 extending across the track 170. This baffle 164 precludes further rotation of the tie plates 900 past aperture 172 and thus urges the tie plates therethrough. At this point the tie plates are oriented so that either the field or gage end first exits opening 172. It is here noted that opening 172 may be selected so as to present a slot to allow only one tie plate to be discharged. However, in some cases, the tie plates may be stacked on track 170 prior to discharge. Opening 172 may be sized so as to allow for stacked plate discharge for further singularization as to be described.

Upon discharge the tie plate is directed into the above-described chute assembly 300 for slidable movement down the inclined ramp surface 306. The chute side walls 310, 312, 314, 316 restrain other movement of the tie plate 900 such that the tie plate will fall onto the motor-powered conveyor surface 3100 therebelow in a desired position, i.e., the width of the tie plates spans the width of the conveyor belt 3100. Bumper 320 assures that a discharged side plate does not travel beyond an end of side walls 316, 318. In some cases a sliding tie plate 900 may flip over on its field or gage end (FIG. 4). Upon bumper 320 impact, such an oriented tie plate 900 will be directed towards the conveyor belt 3100. In some cases the tie plates 900 may become stacked at the discharge end of the chute assembly 300. Accordingly, the bottom edges of side walls 314, 316 are displaced from belt 3100 so as to cooperate with belt 3100 and form a slot slightly greater than a tie plate thickness. Thus, the downstream conveyor 3100 movement will direct only the bottom tie plate of a stack of tie plates to a position downstream from side walls 314, 316 as side walls 314, 316 restrain any downstream movement of the upper tie plates. Once the bottom tie plate is conveyed through slot, an upper tie plate will fall onto the conveyor 3100. Accordingly, tie plates discharged from the housing 100 into chute assembly 300 are assured to be sequentially deposited atop the conveyor 3100.

It is understood that the conveyor belt 3000 assembly depicts one form of assembly that can be used for receiving the tie plate from the singulator housing 100. It is also understood that the motors shown herein may be of various types other than hydraulic motors in fluid communication, via input and return lines, with the hydraulic system of the loader 1000 and thus operable by the loader 1000 operator.

Accordingly, a sequence of tie plates 900 have now been presented for deposit along the railroad track as the vehicle 500 is moved along the track by the loader 1000, this tie plate queue aided by the singulator 100 generally separating the tie plates from the source supply mass and orienting the same. Device 10 thus eliminates a need for a tie plate loader crew at the upstream hopper end. As the tie plates are discharged from housing 100 in a common orientation, various downstream devices can now be devised so as to receive these discharged tie plates for deposit along the course of the railroad track whether directly from the singular housing 100 or chute assembly 300. Of importance is that the labor inefficiencies and other issues arising from worker manipulation of the tie plates are eliminated.

It is to be understood that while a certain form of this invention has been illustrated and described, it is not limited thereto, except in so far as such limitations are included in the following claims and allowable equivalents thereof.

Having thus described the invention, what is claimed as new and desired to be secured by Letters Patent is:

1. A device for sorting tie plates for placement along a railroad track, the tie plates having a generally rectangular configuration with a width extending between field and gage ends, the device comprising:

a frame for supporting said device, said frame adapted for rolling movement along a railroad track;

a housing supported by said frame, said housing comprising a wall forming an enclosure, said wall including exterior and interior surfaces, said housing presenting an upper open end;

a hub within said housing enclosure, said hub presenting a wall displaced from said interior surface of said housing wall;

a bottom wall in said housing, said bottom wall cooperating with said hub wall and said housing interior surface to form a housing track therebetween;

means for rotating said track about an axis passing therethrough;

an opening in said housing wall and adjacent said track for passage of a tie plate therethrough, said track rotation directing tie plates in said track to said opening in said housing wall;

means adjacent said housing wall opening for guiding the tie plates in said housing track through said opening in said housing wall;

a hopper above said housing, said hopper feeding tie plates deposited thereon into said upper open end of said housing, said tie plates falling into said rotating track, said rotation of said track urging the tie plates therein into a desired position on said track;

means exterior of said housing and adjacent said opening in said housing wall for directing a tie plate discharged from said opening away from said housing.

2. The device as claimed in claim 1 further comprising means on said interior surface of said housing wall for further urging the tie plates in said housing track into said desired position on said housing track.

3. The device as claimed in claim 2 wherein said further urging means comprises a plurality of lugs projecting from said interior surface of said housing wall, said lugs contacting tie plates displaced from said desired position during said housing track rotation, said lug contact urging the tie plates to said desired position on said housing track upon said lug contact.

4. The device as claimed in claim 2 wherein said further urging means comprises a band extending between said hub and said interior surface of said housing wall, said band contacting tie plates displaced from said desired position during said track rotation, said band contact urging the tie plates to said desired position on said housing track upon said band contact.

5. The device as claimed in claim 1 wherein a width of said housing track between said hub wall and said interior surface of said housing wall is less than a width of the tie plates, said housing track width orienting said tie plate onto said track wherein the field and gage ends of the tie plate generally transverse the width of said track at said desired tie plate position.

6. The device as claimed in claim 1 wherein said guiding means comprises a baffle adjacent said housing wall opening, said baffle extending across said track for contact with a tie plate on said rotating housing track, said contact guiding a tie plate through said housing wall opening.

7. The device as claimed in claim 1 wherein said directing means comprises a chute assembly, said assembly comprising:

a first end adjacent said housing wall opening;

a second end displaced from said first end and away from said housing;

a ramp between said first and second ends of said chute assembly for slidable movement of a tie plate discharged from said housing wall opening therealong, said ramp having a free end approximate said second end of said chute assembly for discharge of a tie plate therefrom.

8. The device as claimed in claim 7 further comprising:

a conveyor surface adjacent said second end of said chute assembly, a discharge of a tie plate from said free end of said ramp depositing the tie plate onto said conveyor surface.

9. The device as claimed in claim 8 further comprising:

a bumper at second end of said chute assembly to preclude slidable movement of a tie beyond said chute assembly, a contact of a tie plate with said bumper urging a tie plate towards said conveyor surface.

10. The device as claimed in claim 1 wherein said hub presents an upper surface for contact with tie plates fed falling from said hopper, said upper surface directing tie plates in contact therewith into said housing track.

11. The device as claimed in claim 1 wherein said hopper comprises:

a support surface for deposit of tie plates thereon, said support surface presenting a discharge end above said hub in said housing, said tie plates falling from said hopper discharge end onto said hub, said hub directing contacting tie plates into said housing track.

12. The device as claimed in claim 11 wherein said discharge end of said hopper is at a position above said hub wherein tie plates fall from said hopper into said housing track at a location wherein tie plates on said track are initially rotated away from said housing opening.

13. The device as claimed in claim 11 wherein said hopper support surface comprises:

a conveyor belt presenting said support surface;

means for moving said conveyor belt in a direction towards said hopper discharge end for guiding tie plates thereto.

14. The device as claimed in claim 13 further comprising means along said conveyor belt surface for positioning tie plates at said hopper discharge end into a flat position relative to said conveyor belt surface.

15. The device as claimed in claim 14 wherein said positioning means along said conveyor belt surface comprises:

a roller along said conveyor belt surface, said roller displaced from said conveyor belt surface to present a slot for passage of only a tie plate lying flat on the conveyor belt surface therethrough, said roller assembly tipping upstanding tie plates on said conveyor belt surface toward a flat position thereon upon contact therewith.

16. A device for sorting tie plates for placement along a railroad track, the tie plates being generally rectangular in configuration having a width bounded by field and gage ends, the device comprising:

a frame for supporting said device, said frame adapted for rolling movement along a railroad track;

a housing supported by said frame, said housing presenting an enclosure with an input end;

a track within said housing enclosure for receiving tie plates therein;

means for rotating said housing track about an axis passing therethrough;

a hopper, said hopper feeding tie plates into said input end of said housing for deposit of tie plates into said rotating track, said rotation of said track urging the tie plates therein into a flat position on said housing track;

an opening in said housing and adjacent said housing track for passage of a tie plate therethrough, said track rotation directing tie plates to said opening in said housing;

means adjacent said housing opening for discharge of the tie plates on said housing track through said opening in said housing and along a course corresponding to said rolling movement of said frame.

17. The device as claimed in claim 16 further comprising means in said housing and projecting into said housing track for further urging the tie plates into said flat position on said housing track during said housing track rotation.

18. The device as claimed in claim 17 wherein said housing track is configured relative to the tie plates to orient the field and gage ends of the tie plates into a desired position relative to said housing track.

19. A device for orienting tie plates for placement along a railroad track, the tie plates having field and gage ends, the device mounted to a support frame capable of rolling movement along a railroad track, the device comprising:

a housing supported by the frame, said housing presenting an upper inlet for deposit of tie plates therethrough;

a track within said housing for reception of tie plates deposited within said housing;

means for rotating said track about an axis passing through said housing, said rotation of said housing track urging said tie plates into a flat position along said housing track;

an opening in said housing adjacent said track for passage of a tie plate on said housing track therethrough, said track rotation directing the tie plates in said housing track to said opening in said housing;

means adjacent said housing opening for guiding the tie plates in said housing track through said opening in said housing.

20. The device as claimed in claim 19 further comprising:

means projecting into said housing track for further urging the tie plates in said housing track towards said flat position during said housing track rotation.

* * * * *